US008567423B1

(12) United States Patent
Combs, Jr.

(10) Patent No.: US 8,567,423 B1
(45) Date of Patent: Oct. 29, 2013

(54) POLE MOUNT FOR PORTABLE CANOPY ASSEMBLY

(76) Inventor: James B. Combs, Jr., Zionville, NC (US)

( * ) Notice: Subject to any disclaimer, the term of this patent is extended or adjusted under 35 U.S.C. 154(b) by 549 days.

(21) Appl. No.: 12/589,168

(22) Filed: Oct. 19, 2009

(51) Int. Cl.
*E04H 15/32* (2006.01)
*E04H 15/02* (2006.01)

(52) U.S. Cl.
USPC ..... 135/120.3; 135/96

(58) Field of Classification Search
USPC ..... 135/120.1, 120.3, 161, 88.01, 88.13, 135/88.05, 88.07, 88.14, 88.15, 88.16, 135/88.17; 296/136.12, 160, 161; 248/683, 248/537, 206.5, 345
See application file for complete search history.

(56) References Cited

U.S. PATENT DOCUMENTS 809,977 A * 1/1906 O'Brien ..... 138/120
4,830,321 A * 5/1989 Irie ..... 248/206.5
4,850,564 A * 7/1989 Padin ..... 248/533
4,906,347 A * 3/1990 Tomita et al. ..... 204/298.37
5,150,728 A 9/1992 Stark
5,277,214 A 1/1994 Tolley
5,727,583 A 3/1998 Kennedy
5,921,259 A 7/1999 Ehler
6,042,080 A * 3/2000 Shepherd et al. ..... 248/683
6,302,363 B1 * 10/2001 Olson et al. ..... 248/206.5
6,328,047 B1 * 12/2001 Lee ..... 135/20.1
6,739,567 B1 * 5/2004 Curtis ..... 248/548
7,137,661 B2 11/2006 Neuer et al.
7,431,251 B2 * 10/2008 Carnevali ..... 248/206.5
2002/0139403 A1 10/2002 Shi

* cited by examiner

*Primary Examiner* — David Dunn
*Assistant Examiner* — Danielle Jackson
(74) *Attorney, Agent, or Firm* — Schwartz Law Firm, P.C.

(57) ABSTRACT

A pole mount is adapted for locating an elongated pole adjacent a supporting surface. The pole mount includes an enlarged base with an elongated flexible neck. The flexible neck has a proximal end adjacent the base, and a distal end extending outwardly substantially perpendicular to the base. The neck may define a range of universal flexibility between its proximal and distal ends. The distal end of the neck defines an open top adapted for receiving a free end of the elongated pole. A cam lever operates to releasably lock the free end of the elongated pole inside the flexible neck of the pole mount.

8 Claims, 7 Drawing Sheets

POLE MOUNT FOR PORTABLE CANOPY ASSEMBLY

TECHNICAL FIELD AND BACKGROUND

The present disclosure relates broadly to an improved means for attaching one end of an elongated pole to an underlying or overhanging surface. In various implementations, the exemplary pole mount may be used in combination with any form of canopy, including outdoor tents, awnings, hoods, coverings, and the like. Additional exemplary embodiments of the present disclosure may be used in various other applications to locate elongated poles and pole-like structures adjacent any supporting surface.

SUMMARY OF EXEMPLARY EMBODIMENTS

Various exemplary embodiments of the present invention are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

According to one exemplary embodiment, the disclosure comprises a pole mount adapted for locating an elongated pole adjacent a supporting surface. The exemplary pole mount includes an enlarged base with an elongated flexible neck (the base being "enlarged" relative to the neck diameter). The flexible neck has a proximal end adjacent the base, and a distal end extending outwardly substantially perpendicular to the base. The neck may define a range of universal flexibility between its proximal and distal ends. The distal end of the neck defines an open top adapted for receiving a free end of the elongated pole. Means are provided for releasably locking the free end of the elongated pole inside the flexible neck of the pole mount.

The term "supporting surface" is used broadly herein to mean any surface which carries, suspends, supports, or resides adjacent the pole mount.

According to another exemplary embodiment, the enlarged base comprises at least one magnet.

According to another exemplary embodiment, the enlarged base comprises a plurality of individual magnetic tiles.

According to another exemplary embodiment, each magnetic tile is substantially pie-shaped. The term "pie-shaped" means shaped substantially like a slice of pie (or substantially triangular).

According to another exemplary embodiment, the elongated flexible neck comprises a plurality of longitudinally-spaced substantially concentric ribs.

According to another exemplary embodiment, the means for releasably locking comprises a pivotable cam lever located adjacent the distal end of the flexible neck, and having a cam surface adapted for operatively engaging the free end of the elongated pole. Alternatively, the means for releasably locking may comprise other structure including (e.g.) mating friction elements, quick-release buckles, locking nuts and other hardware, adhesives, and the like.

According to another exemplary embodiment, the enlarged base comprises a flexible casing.

According to another exemplary embodiment, the flexible casing comprises neoprene.

According to another exemplary embodiment, a peripheral handle extends radially beyond an edge of a magnetic base, and is adapted for being gripped and pulled to separate the magnetic base from an adjacent metal surface.

According to another exemplary embodiment, the peripheral handle comprises a rigid pry bar removably and separately attached to the magnetic base, and constructed of a metal selected from a group consisting of iron, nickel, cobalt, steel, and alloys incorporating these metals.

According to another exemplary embodiment, a flexible finger loop is attached to the magnetic base, and is adapted for being gripped and pulled to separate said base from the metal surface.

According to another exemplary embodiment, the magnetic base comprises a single disk-shaped magnet.

According to another exemplary embodiment, the magnetic base comprises a flexible casing surrounding the disk-shaped magnet.

In yet another exemplary embodiment, the disclosure comprises a canopy assembly incorporating at least one elongated canopy-support pole, and a pole mount (as described herein) adapted for locating the pole adjacent a supporting surface.

BRIEF DESCRIPTION OF THE DRAWINGS

The description of exemplary embodiments proceeds in conjunction with the following drawings, in which.

DESCRIPTION OF EXEMPLARY EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figures 1, 1A:
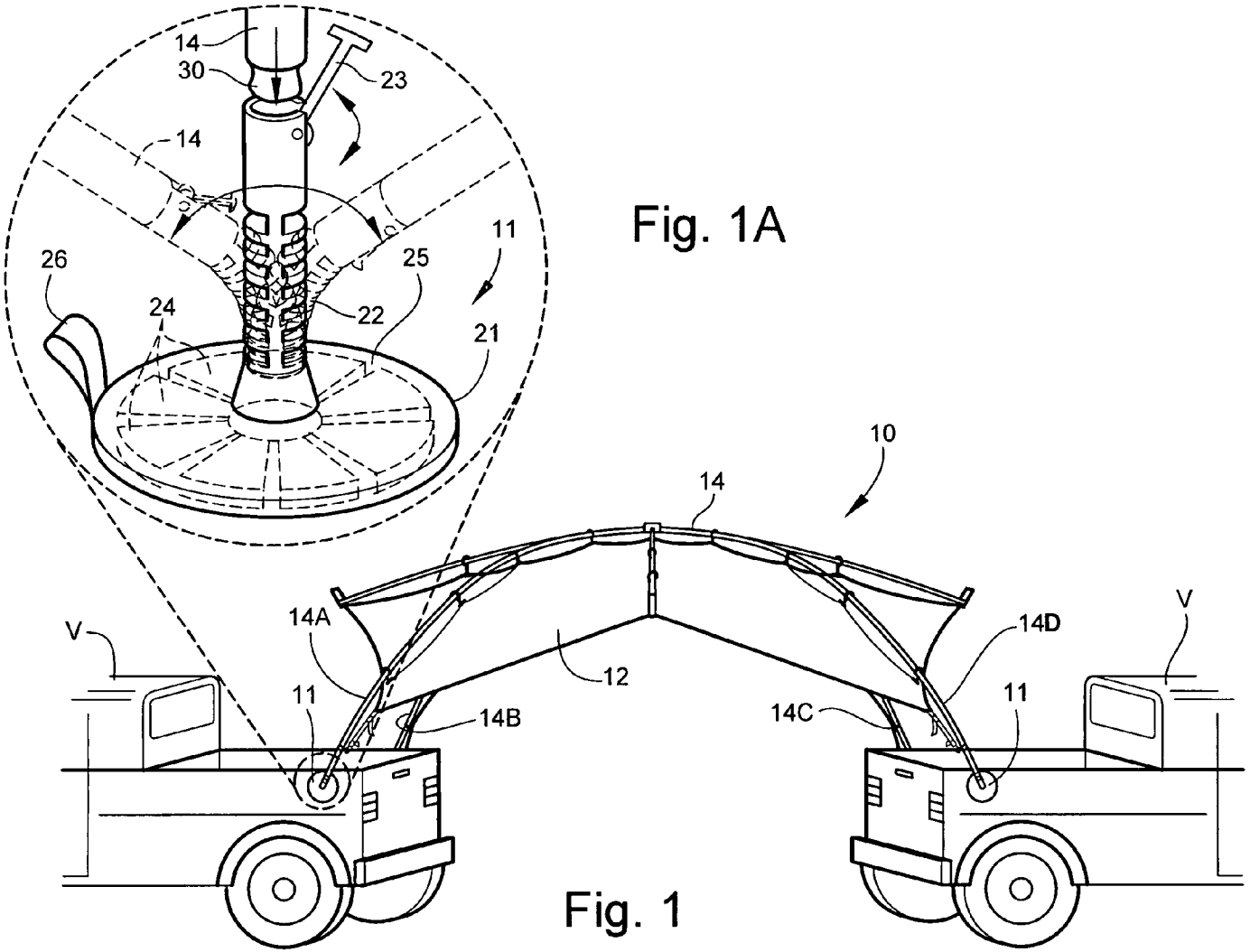
FIG. 1 is an environmental perspective view of a portable canopy assembly according to one exemplary embodiment of the present disclosure.
FIG. 1A is an enlarged view of an exemplary magnetic pole mount.
Figure 2:
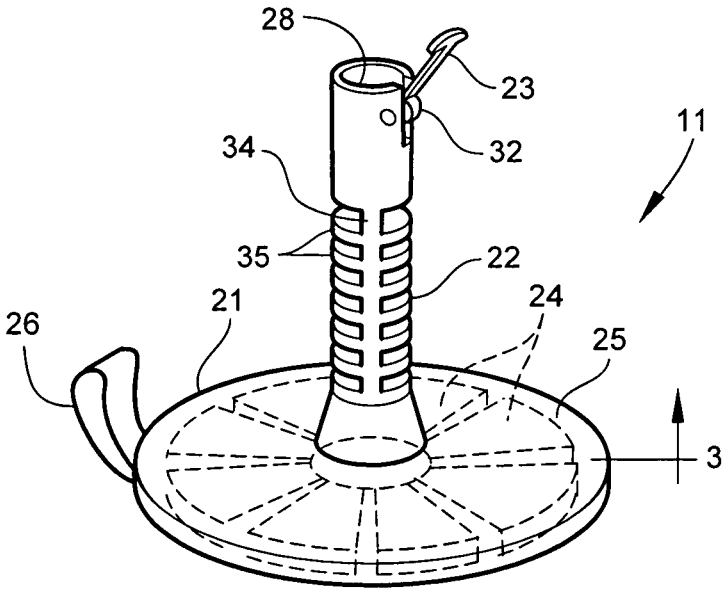
FIG. 2 is a perspective view of the magnetic pole mount.
Figure 3:
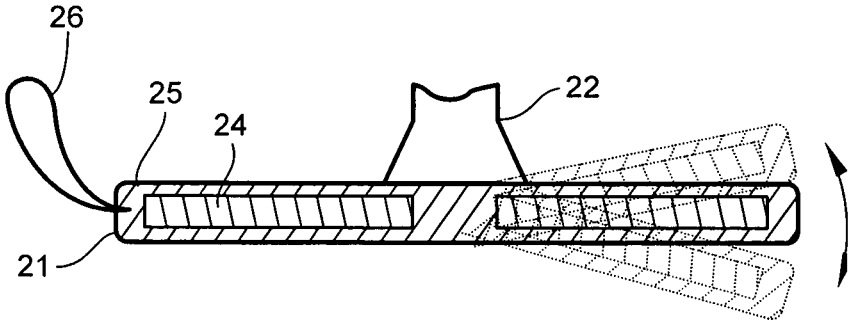
FIG. 3 is a fragmentary cross-sectional view of the magnetic pole mount taken substantially along line 3 of FIG. 2.

Referring now specifically to the drawings, a portable canopy assembly according to one exemplary embodiment of the present invention is illustrated in FIG. 1, and shown generally at reference numeral 10. The canopy assembly 10 includes multiple cooperating pole mounts 11, one or more lightweight fabric canopy sections 12 (including straps and clips), and an arrangement of elongated canopy-support poles 14. The canopy-support poles 14 may be constructed of any suitable rigid, semi-rigid or flexible material, including fiberglass and aluminum. Exemplary pole sizes include 5/16" (7.9 mm) diameter, 3/8" (9.5 mm) diameter, and 7/16" (11 mm) diameter. The canopy poles 14 may be formed in multiple sections and may be shock-corded together in a conventional manner to facilitate assembly, disassembly, and transport. In the embodiment shown, the exemplary canopy assembly 10 includes four elongated flexible "leg" poles 14A, 14B, 14C, 14D extending between spaced-apart parked vehicles "V", and having respective free ends secured to the pole mounts 11 (only two shown). The exemplary pole mounts 11 are magnetically attached to the vehicles "V", as described below. Alternative attachment means may include, for example, mating hook and loop fasteners, adhesives, or the like.

As best shown in FIGS. 1, 1A, 2 and 3, the exemplary pole mount 11 includes an enlarged substantially disk-shaped magnetic base 21, an elongated universally-flexible neck 22, and a pole-locking cam lever 23. The magnetic base 21 attracts various metals (and metal surfaces) including iron, nickel, cobalt, steel, and alloys of these metals. The exemplary base 21 may comprise a number of individual generally pie-shaped magnet tiles 24 closely spaced and circumferentially-arranged about a proximal end of the elongated neck 22. The magnet tiles 24 may be contained within a flexible neoprene cover 25. The cover 25 provides a protective metal-side surface intended to reside between the magnet tiles 24 and the attracted metal surface of the vehicle "V". The magnet tiles 24 are substantially rigid and independently shift-able relative to one another (See FIG. 3), such that the enlarged base 21 of the pole mount 11 bends and folds to substantially conform to contours of the underlying vehicle surface. Additionally, the cover 25 may include an attached finger loop 26 designed for being gripped and pulled to remove the magnetic pole mount 11 from the vehicle "V".

Figure 4A:
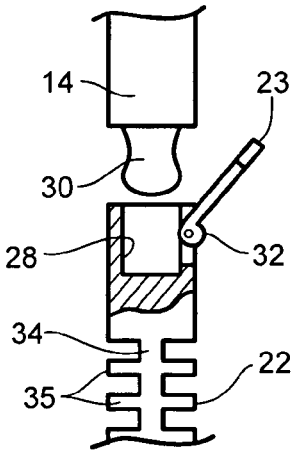
FIGS. 4A, 4B, and 4C are fragmentary sequential views demonstrating attachment of the canopy pole to the exemplary magnetic pole mount.
Figure 4B:
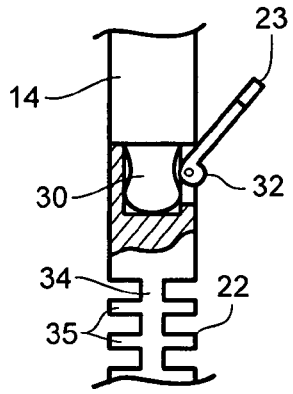
Figure 4C:
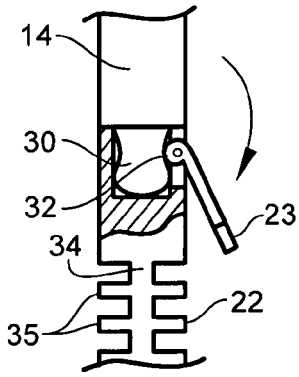

The distal end of the elongated neck 22 extends substantially perpendicularly outward from the enlarged base 21, and defines a reduced-diameter pole-receiving socket 28. The socket 28 is designed to closely receive a steel-tipped free end 30 of the canopy pole 14, as demonstrated in FIG. 1A and FIGS. 4A, 4B, and 4C. With the canopy pole 14 inserted into the neck socket 28, the cam lever 23 may be manually pivoted, as shown in FIGS. 4B and 4C, causing a cam surface 32 to operatively engage the end 30 of canopy pole 14 and releasably lock the pole 14 to the magnetic pole mount 11. When properly locked, the canopy pole 14 may be manipulated in any desired direction by universal flexing of the elongated neck 22 between its proximal and distal ends (See FIG. 1A). The elongated neck 22 may include a spine 34 and series of concentric reinforcing ribs 35 sufficiently spaced-apart to enable substantial longitudinal flexing.

Figure 5:
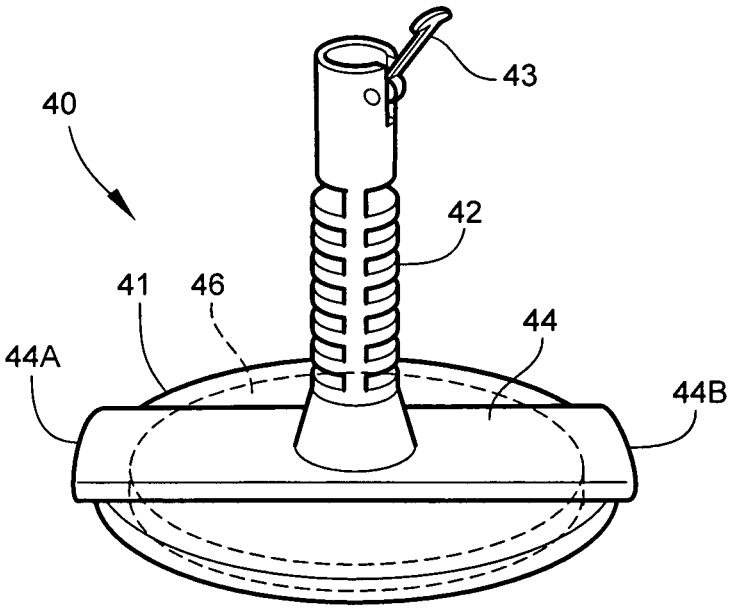
FIG. 5 is a perspective view of an alternative exemplary magnetic pole mount according to the present disclosure.

An alternative embodiment of an exemplary pole mount 40 according the present disclosure is illustrated in FIG. 5. The pole mount 40 includes an enlarged substantially disk-shaped magnetic base 41, an elongated universally-flexible neck 42, and a pole-locking cam lever 43. In this embodiment, the elongated neck 42 is formed with a substantially flat metal pry bar 44 extending at opposite ends slightly beyond a periphery of the magnetic base 41. The opposite ends 44A, 44B define handles designed to be gripped and pulled to separate the pry bar 44 and neck 42 from the magnetic base 41 of the pole mount 40. The magnetic base 41 may comprise a solid rigid or semi-rigid one-piece annular magnet 46 encased in neoprene, as described above. The elongated universally-flexible neck 42 and pole-locking cam lever 43 may function in an identical manner to the previously described neck 22 and cam lever 23 of pole mount 11.

Figures 6, 6A, 6B:
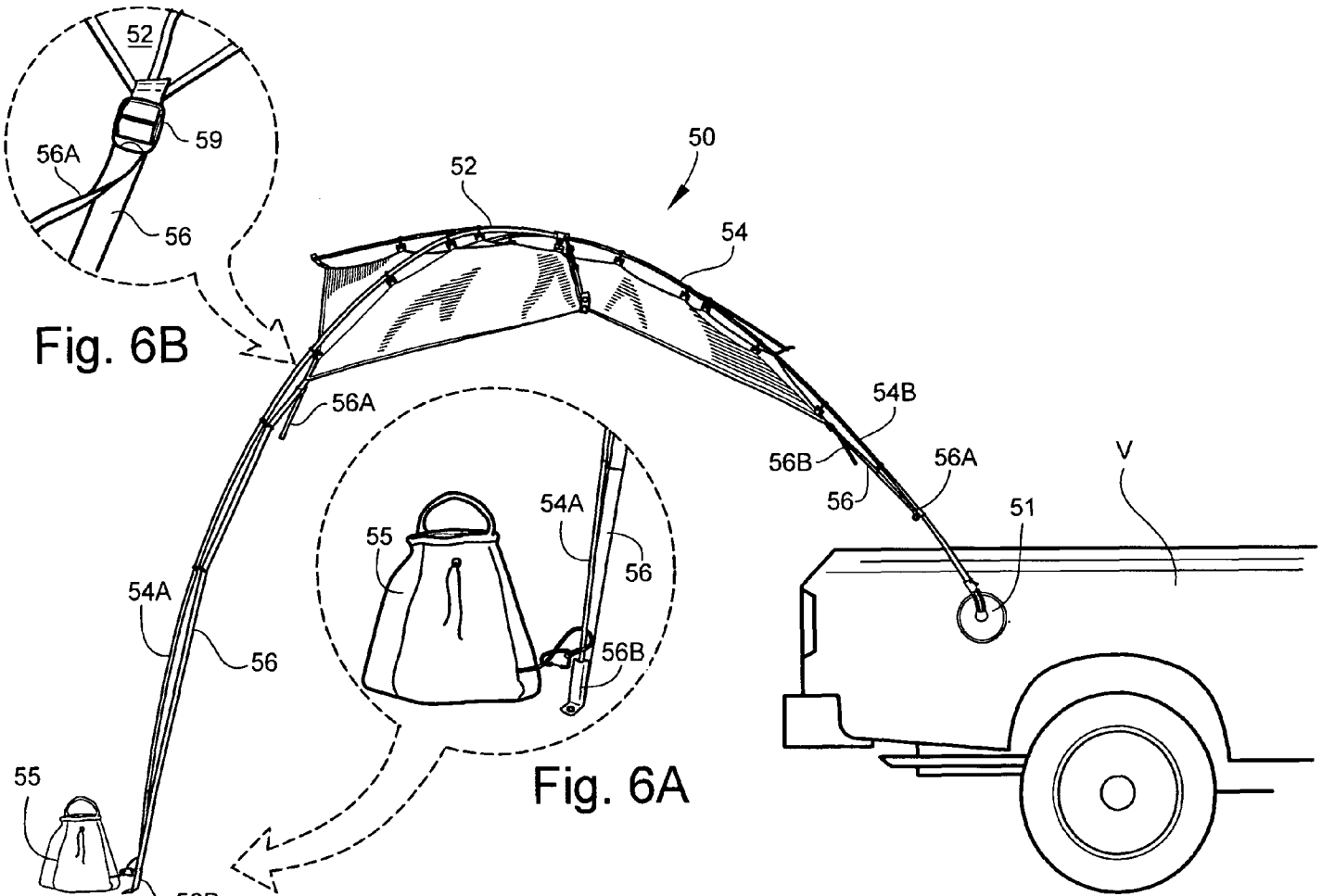
FIG. 6 is environmental perspective view illustrating an alternative implementation of the portable canopy assembly according to the present disclosure.
FIG. 6A is an enlarged view of the weighted sack used to secure a free end the canopy pole.
FIG. 6B is an enlarged view (from an inside of the canopy section) showing a corner of the canopy section, slider, and tensioning strap.

FIG. 6 illustrates a further application of an exemplary canopy assembly 50 according to the present disclosure. As previously described, the canopy assembly 50 comprises a pair of cooperating magnetic pole mounts 51, one or more lightweight fabric canopy sections 52 (including straps and clips), and an arrangement of elongated canopy-support poles 54. The exemplary canopy assembly 50 includes four elongated flexible "leg" poles 54A, 54B (only two shown) comprising shock-corded sections extending between a parked vehicle "V" and the ground. Respective free ends of the poles 54 are secured to the magnetic pole mounts 51, as previously described, and to the ground using weighted sacks 55 (FIG. 6A) and/or tent stakes (not shown).

Figure 7:
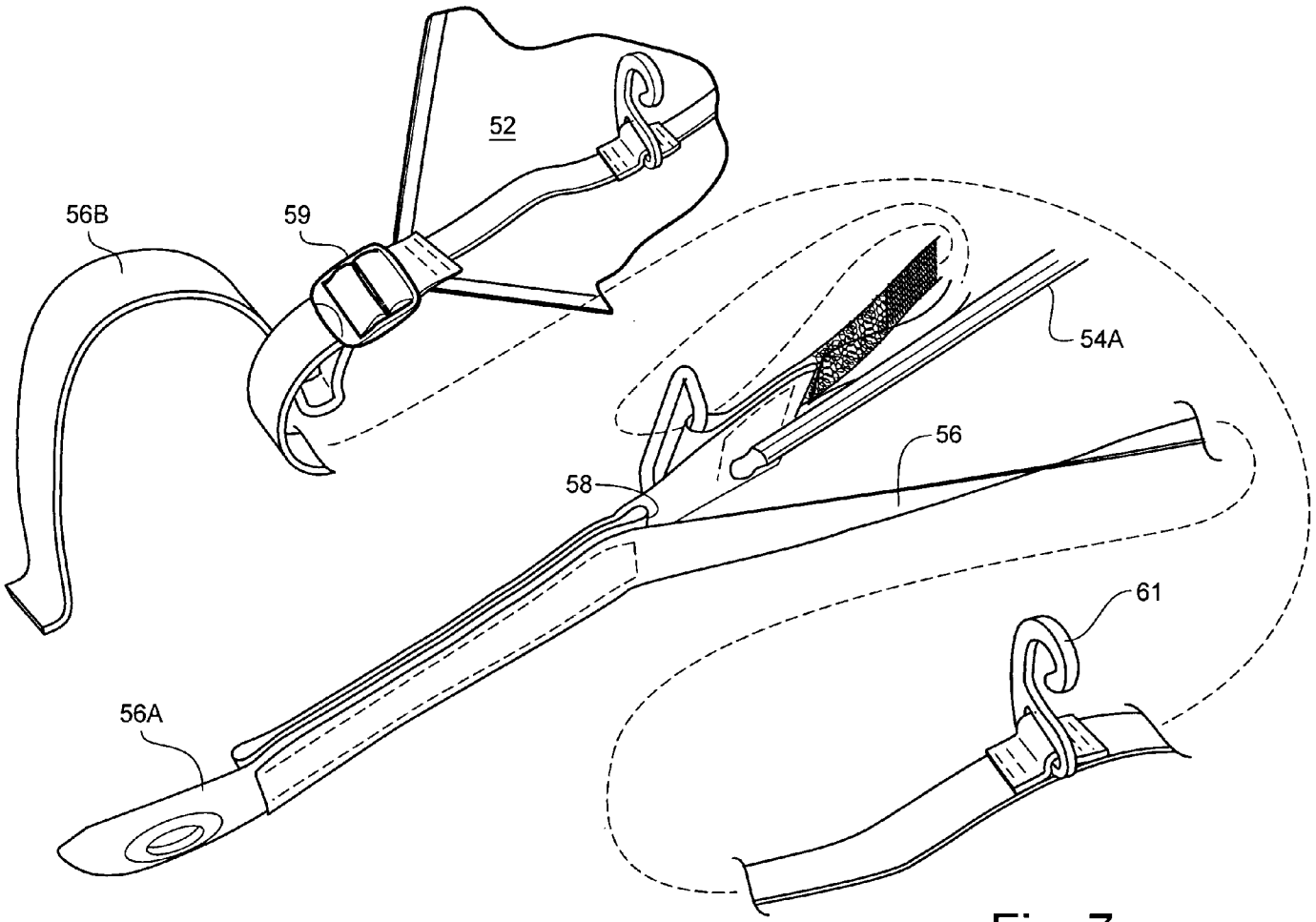
FIG. 7 is an enlarged fragmentary view of the canopy tensioning strap and canopy pole.

The canopy straps 56 may be tensioned, as discussed below, to bend or flex the leg poles 54A, 54B outwardly thereby creating a dome-like covering. As shown in FIG. 7, a free end of the leg pole 54A is inserted into a closed pocket 58 formed (e.g., by sewing) at an anchoring end 56A of the canopy strap 56. The opposite end 56B of the canopy strap 56 is slidably fed through a take-up slider 59 attached at a corner of the canopy section 52, as best shown in FIG. 6B. The intermediate portion of the canopy strap 56 may be held closely adjacent the leg pole by clips 61 shown in FIG. 7. With the canopy pole 54A secured inside the strap pocket 58, the free end 56B of the canopy strap 56 is grasped and pulled under tension causing the leg pole 54A to bend outwardly. The other ground-engaging leg pole (not shown) may be tensioned in an identical manner. For the leg poles 54B secured to the vehicle "V" by magnetic pole mounts 51, respective anchoring ends 56A of the canopy straps 56 may be fixedly attached to the poles 54B proximate their free ends by any suitable means, such as clips, quick-release buckles, cooperating hook and eye parts, or the like. The opposite free ends 56B of the canopy straps 56 may be grasped and pulled, as described above, to bend the leg poles 54B outwardly.

Figure 8:
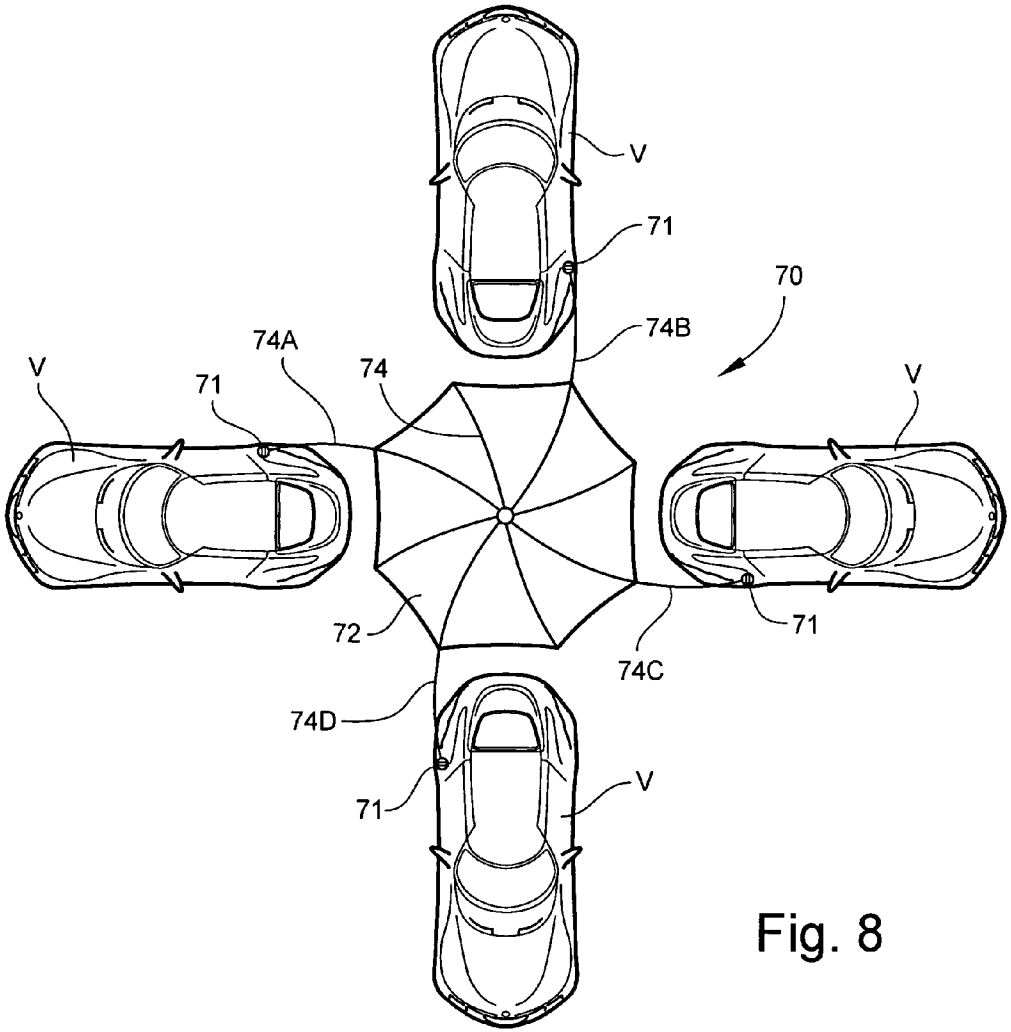
FIG. 8 is environmental perspective view illustrating a further alternative implementation of the portable canopy assembly according to the present disclosure.

Yet another application of an exemplary canopy assembly 70 according to the present disclosure is illustrated in FIG. 8. The canopy assembly 70 includes cooperating magnetic pole mounts 71, one or more lightweight fabric canopy sections 72 (including straps and clips), and an arrangement of elongated canopy-support poles 74. The exemplary canopy assembly 70 has four elongated flexible "leg" poles 74A, 74B, 74C, 74D comprising shock-corded sections extending between four parked vehicles "V". Respective free ends of the poles 74A-74D are secured to the pole mounts 71 magnetically attached to each vehicle "V". The pole mounts 71 may be identical to either of those described above.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under §112, 6th paragraph is not intended. Additionally, it is not intended that the scope of patent protection afforded the present invention be defined by reading into any claim a limitation found herein that does not explicitly appear in the claim itself.

I claim:

1. In combination with a canopy assembly comprising at least one elongated canopy-support pole, a pole mount adapted for locating said elongated pole adjacent a supporting surface, said pole mount comprising:

an enlarged base comprising a flexible casing and a plurality of circumferentially arranged pie-shaped magnetic tiles held within said flexible casing, said magnetic tiles being independently shift-able relative to one another such that said base bends and folds to substantially conform to contours of the supporting surface;

an elongated flexible neck having a proximal end adjacent said base, and a distal end extending outwardly substantially perpendicular to said base, and said elongated neck defining a range of universal flexibility between its proximal and distal ends;

the distal end of said neck defining an open top adapted for receiving therein a free end of the elongated pole; and means for releasably locking the free end of the elongated pole inside the flexible neck of said pole mount.

2. The combination according to claim 1, wherein said elongated flexible neck comprises a plurality of longitudinally-spaced substantially concentric ribs.

3. The combination according to claim 1, wherein said means for releasably locking comprises a pivotable cam lever located adjacent the distal end of said flexible neck, and having a cam surface adapted for operatively engaging the free end of the elongated pole.

4. The combination according to claim 1, wherein said flexible casing comprises neoprene.

5. In combination with a canopy assembly comprising, at least one elongated canopy-support pole, a pole mount adapted for locating said elongated pole adjacent a supporting surface, said pole mount comprising:

an enlarged magnetic base comprising a flexible casing and a plurality of circumferentially arranged pie-shaped magnetic tiles held within said flexible casing, said magnetic tiles being independently shift-able relative to one another such that said base bends and folds to substantially conform to contours of the supporting surface;

an elongated flexible neck having a proximal end adjacent said base, and a distal end extending outwardly substantially perpendicular to said base, and said elongated neck defining a range of universal flexibility between its proximal and distal ends;

the distal end of said neck defining an open top adapted for receiving therein a free end of the elongated pole; and means for releasably locking the free end of the elongated pole inside the flexible neck of said pole mount.

6. The combination according to claim 5, and comprising a flexible finger loop attached to said enlarged magnetic base and adapted for being gripped and pulled to separate said base from the metal surface.

7. The combination according to claim 5, wherein said elongated flexible neck comprises a plurality of longitudinally-spaced substantially concentric ribs.

8. The combination according to claim 5, wherein said means for releasably locking comprises a pivotable cam lever located adjacent the distal end of said flexible neck, and having a cam surface adapted for operatively engaging the free end of the elongated pole.

* * * * *